US005619833A

United States Patent [19]

Neff

[11] Patent Number: 5,619,833

[45] Date of Patent: Apr. 15, 1997

[54] SUSPENDED CEILING SYSTEM

[76] Inventor: Eric S. Neff, R.D. #2, Box 1737, Chicora, Pa. 16025

[21] Appl. No.: 378,580

[22] Filed: Jan. 26, 1995

[51] Int. Cl.[6] ..... E04B 9/18

[52] U.S. Cl. ..... 52/506.07; 52/506.06; 52/506.05; 52/664

[58] Field of Search ..... 52/506.07, 506.06, 52/665, 506.05, 510, 664

[56] References Cited

U.S. PATENT DOCUMENTS

| | | | |
|---|---|---|---|
| 4,505,083 | 3/1985 | Mieyel | 52/506.07 X |
| 4,569,175 | 2/1986 | Abciuk | 52/506.07 |
| 4,624,088 | 11/1986 | Arent | 52/506.07 |
| 4,742,662 | 5/1988 | Smith | 52/506.07 X |
| 4,884,383 | 12/1989 | Rijnders | 52/506.07 |
| 5,239,801 | 8/1993 | Adams | 52/665 X |
| 5,279,090 | 1/1994 | Yamaguchi et al. | 52/665 X |
| 5,433,048 | 7/1995 | Strosser | 52/506.07 X |

*Primary Examiner*—Carl D. Friedman
*Assistant Examiner*—W. Glenn Edwards
*Attorney, Agent, or Firm*—George C. Atwell

[57] ABSTRACT

A suspended ceiling system for suspension from an overhead ceiling of a room is disclosed which includes a plurality of wall trim members secured to the room walls, a plurality of main runner members extending from the wall trim members in a horizontal plane for spanning the room and a plurality of cross braces interlocking with the main runner members and forming a grid for receiving ceiling tiles, panels, fixtures, and the like. A plurality of clips are slidably disposed on the wall trim members, main runner members, and the cross braces to suspend those members from the ceiling and to support the main runner members and cross braces at intersection points in the grid. In addition, for an in-place suspended ceiling framework that includes L-shaped metal wall angles secured to the walls of the room and metal main runners and metal cross braces spanning the room to form a grid beneath the ceiling, an improvement is disclosed which includes wall trim cover members for covering the metal wall angles, main runner cover members for covering the metal main runners, and cross brace cover members for covering the metal cross braces. The wall trim members, main runner cover members, and cross brace cover members preferably simulate a wood appearance and are removably attachable to the various suspended ceiling framework structural components.

13 Claims, 7 Drawing Sheets

SUSPENDED CEILING SYSTEM

BACKGROUND OF THE INVENTION

This invention pertains to suspended ceiling systems, and more particularly pertains to a suspended ceiling system constructed from a lightweight, pliable material, such as extruded or injection molded plastic, for suspension from an overhead surface.

The home remodeling industry has increased dramatically in recent years as more and more homeowners are taking matters into their own hands when the decision is made to remodel or redesign their dwellings. Among the primary remodeling projects are adding rooms to a house, enlarging a kitchen to increase the shelf space and cooking area, turning a cement basement into a game room or family room, and installing a drop—or suspended—ceiling to cover unsightly rafters, electrical conductors, and duct work and provide an aesthetically appealing overhead surface of ceiling tiles and lighting fixtures. Numerous chain and retail stores sell the tools and equipment to engage in a home remodeling project, and among the better known stores are Home Depot, 84 Lumber, Busy Beaver, K-Mart, and Wal-Mart.

The simplest type of suspended ceiling structure includes metal wall angles for attachment to the walls of a room, metal main runner members or cross-T's and metal cross braces for spanning the room and forming a grid beneath the overhead ceiling for supporting ceiling tiles or panels within the grid formed by the main runner members, cross-T's and cross braces. Various types of hanger structures or devices are used to hang the runner members, cross-T's and cross braces from the rafters or beams forming the overhead ceiling.

There have been numerous improvements to the simple, above-described suspended ceiling structure, and the improvements have been in the materials out of which the structural components are manufactured, improvements in the method or manner the various structural components are joined to each other, and improvements in the method or manner of suspending the structural components from the overhead surface.

For example U.S. Pat. No. 3,768,224 discloses a sub-ceiling grid system whereby the main runners and the cross runners are interlocked together by splices for forming a clipless grid system. U.S. Pat. No. 4,281,498 discloses a wooden suspended ceiling using locking blocks for attaching the cross beams to each other. U.S. Pat. No. 4,464,876 discloses a suspended woodbeam ceiling in which the cross-beams are suspended by locking clips and U-shaped connectors. U.S. Pat. No. 4,454,700 also discloses a suspended woodbeam ceiling with specially designed locking clips.

U.S. Pat. No. 4,773,200 discloses a wooden suspended ceiling system comprising wooden runners and cross members shaped to interconnect with each other to form a rectangular grid system. U.S. Pat. No. 4,841,709 discloses a suspended ceiling system having wooden main beams and cross beams connected together by wooden blocks.

Other suspended ceiling structures include U.S. Pat. No. 3,470,666 which utilizes a center beam from which ceiling tiles can be erected in serial rows, the suspended ceiling system of U.S. Pat. No. 3,385,020 wherein wooden cross-pieces and runners are interconnected to form a grid system, and U.S. Pat. No. 3,583,119 which discloses the utilization of simulated woodgrain risers resting upon flanges of the grid members.

However, despite the ingenuity of the above suspended ceiling systems, there remains a need for a suspended ceiling system which is lightweight, easy to install, and requires only the simplest of tools to assist in the installation.

SUMMARY OF THE INVENTION

The present invention comprehends a suspended ceiling system which is suspended from an overhead surface or ceiling of a room to create a grid therebelow for supporting ceiling tiles, panels, lighting fixtures and the like.

The suspended ceiling system of the present invention includes a plurality of wall trim members which are secured to the walls of the room to form a perimeter around the room. A plurality of elongated main runner members are secured to one wall trim member in spaced-apart relationship to each other and then are suspended from the ceiling. Successive main runner members are then abutted to the ends of the main runner members which extend from the wall trim member and then they are also suspended from the ceiling. The main runner members are disposed end-to-end so that they span the room and the last row of main runner members abut the wall trim member secured to the opposite wall. A plurality of cross braces are then disposed so as to interlock or interfit with the main runner members perpendicularly thereto to form a grid beneath the ceiling for supporting tiles, panels, lighting fixtures and the like. The wall trim members, main runner members and cross braces are suspended from the ceiling in the same horizontal plane.

The suspended ceiling system of the present invention utilizes an adjustable hanging means to suspend the main runner members and the cross braces from the ceiling. The hanging means includes a plurality of clips which are capable of slidable, adjustable, linear movement on the main runner members and the cross braces so that the clips can be properly positioned thereon for suspending the main runner members and the cross braces from the ceiling. Each clip includes a pair of opposed sidewalls, each of which includes a centrally-located notch, a top flat, horizontal surface portion and an arched member projecting upwardly therefrom. The arched member further defines an aperture through which a wire can be inserted. The other end of the wire can be attached to a fastener, such as a wood screw, drilled into an overhead joist or beam of the ceiling. The clips have four purposes: 1) to attach the end portions of the main runner members to the flat, vertical portions of the wall trim members; 2) to support from the overhead ceiling the main runner members in their horizontal extension across the room; 3) to connect cross braces to main runner members at intersection points in the grid; and 4) to span and connect together the end portions of two abutting main runner members.

An alternate embodiment is adapted for a suspended ceiling framework already in-place beneath an overhead ceiling and which comprises a plurality of L-shaped metal wall angles secured to the walls of the room to form a perimeter thereon, a plurality of elongated, inverted, T-shaped metal main runners which extend from the metal wall angle secured to one wall and span the room for attachment to the metal wall angle secured to the opposite wall, and a plurality of elongated, inverted, T-shaped cross braces which interconnect with and are disposed perpendicular to the metal main runners to form a grid beneath the ceiling for receiving ceiling tiles, panels, lighting fixtures, and the like.

The alternate embodiment is designed to give a wood finish or wood grain appearance to the suspended ceiling framework by providing structural members which completely cover the metal structural elements of the in-place suspended ceiling framework.

The structural members include a plurality of elongated wall trim cover members which rest upon and cover the L-shaped metal wall angles, a plurality of elongated, generally V-shaped main runner covers members which rest upon and completely cover the T-shaped metal main runners and a plurality of elongated, generally V-shaped cross brace cover members which rest upon and completely cover the T-shaped metal cross braces. Thus, when the structural members of the alternate embodiment are disposed on the elements of the suspended ceiling framework, a person standing in the room and looking up at the ceiling would see a wooden suspended ceiling grid supporting and framing ceiling tiles and panels, and not the metal structural elements comprising the suspended ceiling framework.

The alternate embodiment also includes a plurality of inside and outside cover members which are disposed to rest upon and cover the end portions of the metal wall angles that meet at the inside or outside right-angled corners of the room or rooms.

It is an objective of the present invention to provide a suspended ceiling system which is lightweight, flexible, and easy to install in rooms of varying dimensions.

It is another objective of the present invention to provide a suspended ceiling system which includes an adjustable hanging means for suspending the system beneath an overhead surface in a horizontal plane.

Yet another objective of the present invention is to provide a suspended ceiling system which requires the simplest of tools for installation.

Still another objective of the present invention is to provide an alternate embodiment for covering the metal structural components of an in-place suspended ceiling framework in order to provide a simulated wood appearance for individuals standing in the room and looking up at the suspended ceiling framework.

Other features of the invention and the advantages presented thereby will become apparent as the description herein proceeds.

DETAILED DESCRIPTION OF THE PREFERRED EMBODIMENT

Illustrated in FIGS. 1–5 is a suspended ceiling system 10 for suspension from an overhead ceiling or surface. The system 10 is spaced from the overhead ceiling and forms a grid 12 therebelow for supporting light fixture panels, air filter modules, blank panels, ceiling tiles 14, etc. The room should have at least two opposed walls for supporting the grid 12 formed by the suspension of the system 10, and, typically, the suspended—or drop—ceiling system 10 will be disposed in a game room or basement to brighten and enhance the appearance of those respective rooms. The system 10 illustrated in FIGS. 1–5 may be constructed out of wood or out of a plastic material such as pvc, styrene, or polyethylene; but the material should be lightweight, pliable and easy to lift and manipulate by one individual.

Figure 1:
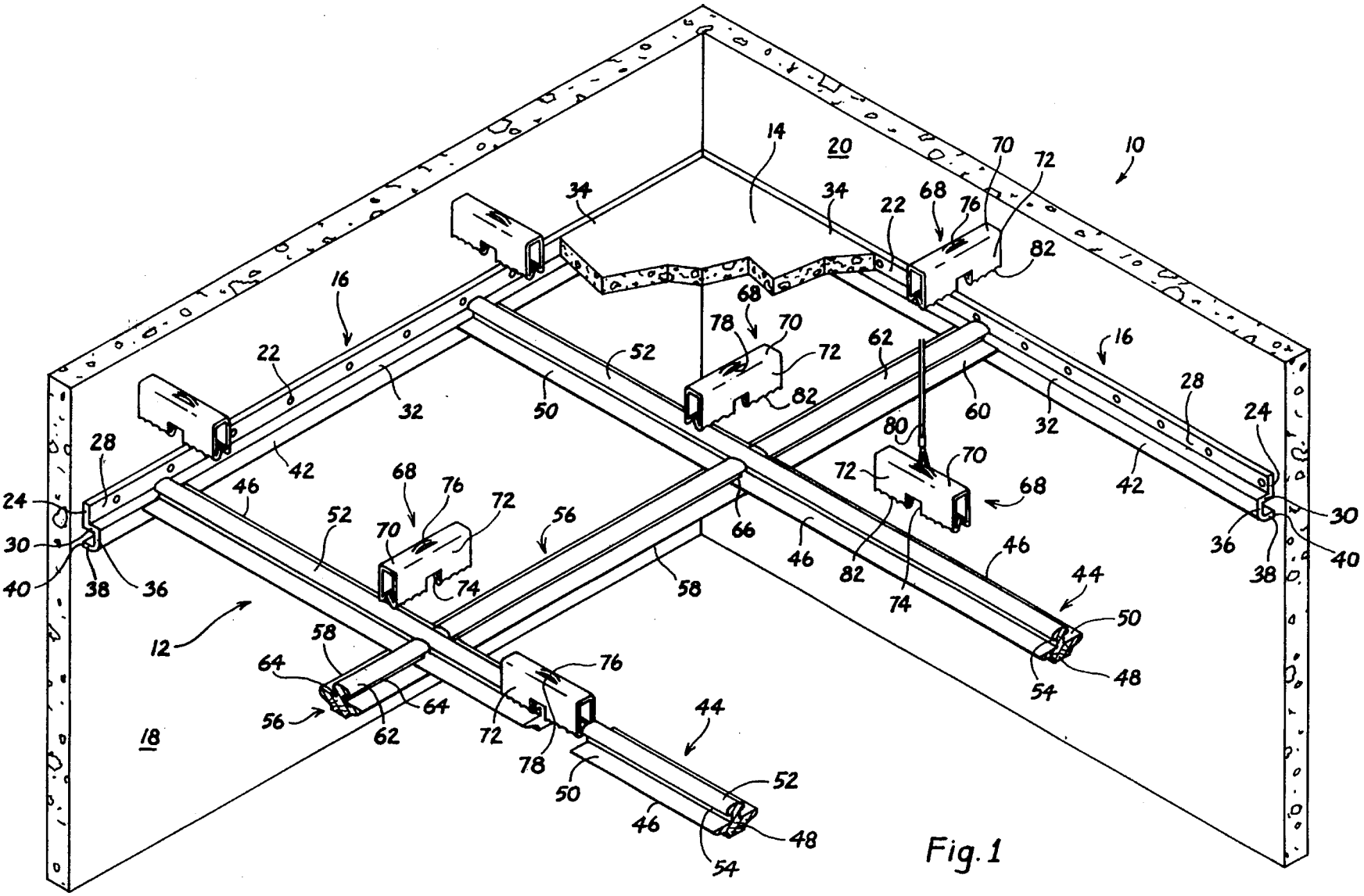
FIG. 1 is an isometric view of the first preferred embodiment of suspended ceiling system with structural components broken away and taken in section.
Figure 2:
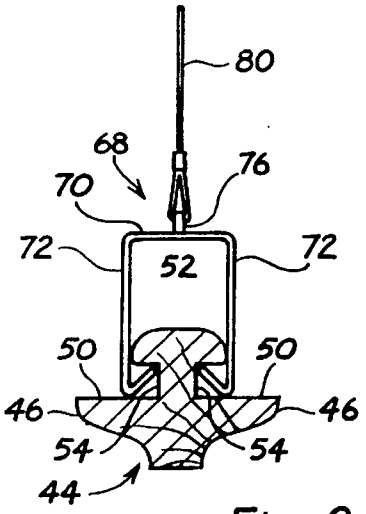
FIG. 2 is an enlarged fragmentary front elevational view of the suspended ceiling system first shown in FIG. 1 illustrating a main runner member with a clip attached thereto.

As illustrated in FIGS. 1–5, the system 10 of the present invention includes a plurality of elongated wall trim members 16 which are secured to the walls of the room. FIG. 1 illustrates two adjacent walls 18 and 20. The members 16 are secured to the walls 18 and 20 by any of a variety of fasteners 22, such as wood screws, anchor screws, or toggle bolts, and the members 16 are disposed the same distance from the ceiling to form a perimeter on the walls 18 and 20. As illustrated in FIGS. 1 and 2, the members 16 have a unique profile which facilitates the installation of the system 10 and allows simple and quick joining and connection to other structural elements hereinafter further described. Thus, each member 16 includes a flat, elongated vertical portion 24 having a rear surface 26 which is contiguous with the respective wall 18 or 20 and a facing surface 28 which faces inward toward the room when the members 16 are secured to the walls 18 and 20. A flat, elongated horizontal portion 30 is integrally joined to the portion 24 to form an L, and an upwardly-facing surface 32 of the portion 30 is adapted to receive and support thereon edges 34 of the tiles 14 as well as other structural elements hereinafter further described.

In addition, each member 16 includes a flat, elongated downwardly-projecting portion 36 which is coequal in length or extension with the horizontal portion 30 and vertical portion 24. The portion 36 is integrally attached to the portion 30 at an upper end and, further, the portion 36 has a lower end which projects downwardly away from the ceiling and toward the floor. Finally, each member 16 includes a molded portion 38 which is coequal in length with the vertical portion 24, the horizontal portion 30, and the downwardly-projecting portion 36. The portion 38 also includes a lower molded end 40 which abuts the wall 18 or 20 to which the member 16 is secured as shown in FIG. 1. The molded portion 38 can be shaped or formed into any number of different profiles; the profiles shown in FIGS. 1 and 2 are only one example, and there can be many others. In order to keep the members 16 as lightweight and flexible as possible for ease and simplicity of installation, the dimensions have been kept to a minimum: the width of the portion 24 is approximately 3/16 of an inch and the width of the surface 32 is approximately 3/8 of an inch while the length of the portion 36 is also approximately 3/8 of an inch. It should also be noted that the portion 36 presents a flat surface 42 against which structural elements hereinafter further described can be butted against.

As illustrated in FIGS. 1–5, the system 10 also includes a plurality of elongated main runner members 44 which are disposed in the same horizontal plane beneath the ceiling for spanning the room from one member 16 to the opposite member 16. Each member 44 includes a pair of oppositely-disposed, horizontally-projecting arms 46 which are coequal in length with the respective member 44. Each member 44 terminates at a pair of oppositely-disposed, flat, vertical end portions 48; it is the end portions 48 which abut the surface 42 as shown in FIG. 1. Each arm 46 includes a flat receiving surface 50 upon which the edges 34 of the ceiling tiles 14 will rest when the grid 12 is disposed beneath the ceiling and the ceiling tiles 14 are placed within and supported by the grid 12. Further, as shown in FIG. 1, each member 44 includes an upraised, inverted, generally V-shaped or mushroom-shaped runner portion 52 which is coequal in length with the arms 46 and terminates at the opposed end portions 48. In addition, a channel or groove 54 is formed on each member 44 at the point where the runner portion 52 extends upwardly from each arm 46. The channel 54 may be no deeper than 3/32 of an inch, but it is necessary so that a structural element hereinafter further described can be properly attached to the runner portion 52.

Figure 3:
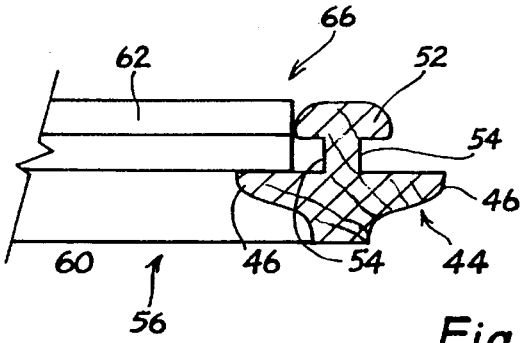
FIG. 3 is an enlarged fragmentary view of the suspended ceiling system first shown in FIG. 1 illustrating a cross brace interlocking with a main runner member with a clip attached to the main runnel member.

In addition to the members 44 shown in FIGS. 1–5, the system 10 includes a plurality of elongated cross braces 56 which are attached and interlocked to the members 44 at right angles to form the grid 12 beneath the ceiling for supporting the tiles 14. Each cross brace 56 includes a pair of oppositely-disposed, horizontally-projecting cross brace arms 58 which are coequal in length with the main body portion of the cross brace 56. Each arm 58 further defines an upwardly-facing flat surface 60 for receiving and supporting thereon ceiling tiles 14, panels and the like. Furthermore, similar to the members 44, the cross braces 56 include an upraised, inverted, generally mushroom-shaped or V-shaped portion 62 which is located between each arm 58 and projects upwardly therefrom a short distance. Moreover, as illustrated in FIG. 1, each cross brace 56 includes a pair of oppositely-disposed, elongated rabbets 64 which extend the length of the cross brace 56 and are formed in the area where the portion 62 projects upwardly from each arm 58. In order to attach and interlock the cross braces 56 to the members 44, each cross brace 56 includes oppositely-disposed notched or coped ends 66 for interlocking with the arms 46 as shown in FIG. 3.

In order to properly suspend the system 10 from the overhead surface, an adjustable hanging means is employed for properly suspending the members 44 and the cross braces 56 from the overhead surface as well as performing several other functions which will be hereinafter further described. The adjustable hanging means of the present invention includes a plurality of clips 68 which can be attached to the cross braces 56 and the members 44 and which are capable of slidable, linear, reciprocal movement on the cross braces 56 and members 44 so that the clips 68 can be properly positioned thereon in order to suspend the system 10. Also, the clips 68 facilitate the suspension of the cross braces 56 and the members 44 from the overhead surface in a level, spaced-apart disposition so that the grid 12 will lie in the same horizontal plane and be spaced an equal distance from the overhead surface.

As shown in FIGS. 1–4, each clip 68 includes a flat, horizontal surface portion 70 and a pair of spaced-apart, oppositely-disposed, vertical sidewalls 72 integrally attached to and depending from the surface portion 70. In addition, each sidewall 72 includes a centrally-located notch 74 adjacent its lower edge, and the notch 74 of one sidewall 72 is aligned with and has the same dimensions as the notch 74 of the opposed sidewall 72. Further, each clip 68 includes an arched member 76 which projects slightly above the surface portion 70 and which defines an aperture 78 between the arched member 76 and the surface portion 70. A chain or wire 80 can be looped through the aperture 78 for suspending the clips 68 from the overhead surface. Furthermore, the lower end of each sidewall 72 terminates with a row of serrated teeth 82 which slightly dig into the projecting arms 46 and 58 and the runner portions 52 and 62 as well as the upwardly-facing surfaces 32 so as to prevent the clips 68 from sliding when positioned on these structural elements. By pressing down on the clips 68, the teeth 82 can dig slightly into the members 16 and 44 and the cross braces 56. More specifically, as shown in FIGS. 1 and 2, the sidewalls 72 of each clip 68 abut and enclose the runner portions 52 and 62 and the cross braces 56. The sidewalls 72 are flexible and can be pushed down upon the runner portions 52 and 62, and their pliability allows the sidewalls 72 to spread outward and conform to the shape of the runner portions 52 and 62. The lower ends of the sidewalls 72 then slightly project into the channels 54 and the rabbets 64, and this prevents the clips 68 from lifting off of the members 44 and cross braces 56 when the clips 68 are disposed thereon for suspension from the overhead surface by the wires 80, one of which is illustrated in FIG. 1.

Figure 4:
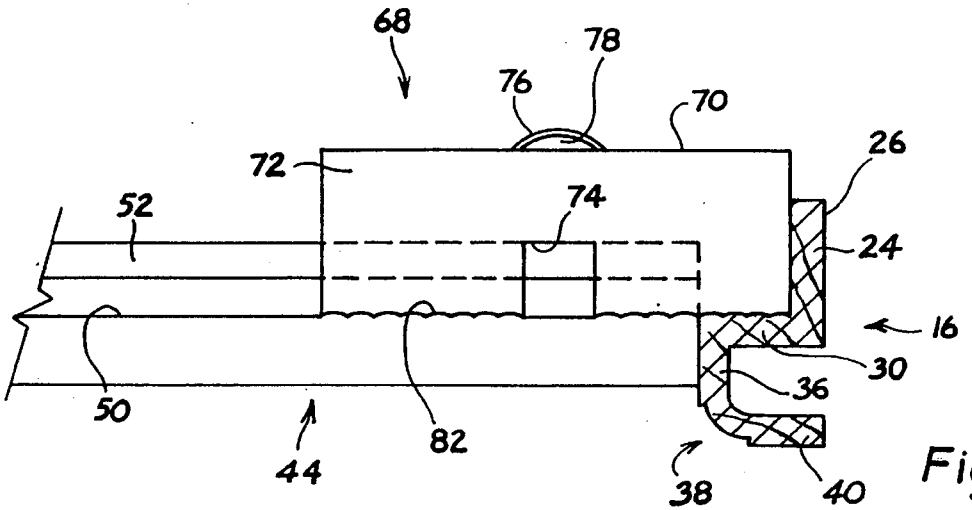
FIG. 4 is an enlarged fragmentary side elevational view of the suspended ceiling system first shown in FIG. 1 illustrating a main runner member abutting a wall trim member and secured in place with a clip.

As illustrated in FIG. 1, the clips 68 have four purposes which facilitate the suspension of the system 10 from the ceiling. The clips 68 can be used to attach a member 44 to a member 16 by pressing the clip 68 onto the runner portion 52 of the member 44 and then sliding the clip 68 so that half of both sidewalls 72 project past the end portion 48. The lower ends of the sidewalls 72 can then rest upon the upwardly-facing surface 32. This is shown in FIG. 4. The clips 68 can also support the members 44 in their horizontal extension across the room by attaching clips 68 to the runner portions 52 and then looping a portion of the wire 80 through the aperture 78 or tying one end of the wire 80 to the arched member 76 and then attaching the other end of the wire 80 to a fastener which is drilled into the ceiling. A third purpose of the clips 68 is to connect a pair of cross braces 56 to a runner member 44 at an intersection point in the grid 12. The coped ends 66 of two adjacent cross braces 56 are interlocked with the arms 46 of one runner member 44, as shown in FIGS. 1 and 3, and then one clip 68 is pressed down upon the runner portion 52 of the member 44 so that the notch 74 of the clip 68 receives the runner portion 52 and the teeth 82 dig into the flat surface of the arms 58. Finally, the clips 68 are used to span and connect two adjacent runner members 44 so that the end portion 48 of one runner member 44 is abutted against the end portion 48 of an adjacent runner member 44. In this case, one clip 68 is pressed down upon the runner portion 52 of an already suspended main runner member 44 and then the clip 68 is slid forward so that approximately half of the clip 68 projects past the end portion 48 of that main runner member 44. Then the next runner member 44 is lifted up and aligned so that its runner portion 48 will slide between the sidewalls 72 of the already attached clip 68. The individual then pushes this runner member 44 so that its end portion 48 abuts the end portion 48 of the already suspended runner member 44. The clip 68 now spans, connects, and suspends the end portions 48 of two abutting main runner members 44.

There are many ways of installing the suspended ceiling system 10 of the present invention in, for example, a gameroom or a basement. What follows is one example of a description of the steps or procedures required to install the system 10 in such a room. The tools necessary for the installation are a tape measure, a utility knife, a hammer, along with fasteners, such as various types of screws, and lengths of wire or wire loops for suspending the grid 12 from the overhead ceiling or surface. In addition, a miter saw may be required if two walls meet at a beveled angle.

The first step in installing the system 10 is to measure on all the walls a fixed distance down from the ceiling on each of the respective walls. Light pencil or chalk marks should mark this distance, and then a horizontal line should be lightly drawn or placed on each wall so that the lines form a perimeter on the respective walls. The lines should be in the same horizontal plane and should all be the same distance from the ceiling, or, conversely, from the floor. Next, the members 16 should be secured to the respective walls, two of which are shown in FIG. 1 and denoted by reference numbers 18 and 20, by placing the members 16 against the walls 18 and 20 and on the respective horizontally drawn lines. A wide variety of fasteners 22 can be used to secure the members 16 to the walls 18 and 20 depending upon the composition of the walls and the framework supporting the wall. For example, wood screws can be drilled through the vertical portion 24 of the members 16 and into studding supporting the walls 18 and 20. As shown in FIG. 1, the wood screws should be equidistantly spaced along the vertical portions 24 and a sufficient number of wood screws should be used so that the rear surface 26 of vertical portions 24 is continuous with the walls 18 and 20 and there are no gaps between the walls 18 and 20 and the members 16. The standard length of the members 16 is eight feet, and members 16 should be secured to all the walls. A utility knife or a miter saw can be used to cut or miter the ends of members 16 where two members 16 meet at a corner of the room which is not a right angle. The members 16 have a very thin profile, and if a standard length member 16 is too long for the wall, the member 16 can be easily cut by a utility knife or a miter saw.

Once the members 16 are secured to the respective walls of the room, the next step is to start the extension of the main runner members 44 from one member 16 so that the members 44 span the room and reach the member 16 secured to the opposite wall. Clips 68 are attached to,the end portions 48 of the initial main runner members 44 so that approximately half of each clip 68 overhangs or projects out from the end portions 48. The initial main runner members 44 are then butted against the flat surface 42 of the portion 36 of the members 16. The lower ends of the overhanging halves of the clips 68 rest upon the surface 32 of the horizontal portion 30 of the member 16. These clips 68 can be then secured to the ceiling by the use of wire 80 looped around and tied to the arched members 76 and fasteners and other clips 68 can be attached along the runner portions 52 of the initial main runner members 44 for attachment to the ceiling through the use of wire 80 attached to fasteners inserted into the ceiling. The initial main runner members 44 should project from the member 16 in the same horizontal plane and should be spaced an equal distance from each other.

After suspension of the initial or starting main runner members 44 from the ceiling, the next step is to abut as many runner members 44 as is necessary, one after another, to the starter main runner members 44 until the room is spanned and the member 16 secured to the opposite wall is reached. Main runner members 44 may come in lengths of eight or ten feet so in a basement or gameroom it may require no more than two members 44 to span the room while for a department store, for example, a half dozen members 44 may be needed to span the room from one wall to the opposite wall. The members 44 are placed one after another in linear succession in the same horizontal plane until the room is spanned, and the end portion 48 of one main runner member 44 abuts the end portions 48 of the next member 44. As each line of members 44 is installed, clips 68 may be attached to the runner portions 52 along the length thereof as desired to support the members 44 in their suspension from the ceiling.

If the distance between the next-to-last runner members 44 and the member 16 secured to the opposite wall is not eight or ten feet, then the installer can simply measure the distance between the end portions 48 of the row of next-to-last runner members 44 and the flat surface 42 of the portion 36 of the opposite member 16 and then cut the last main runner members 44 so that they span this distance. A straight cut is all that is required since clips 68 are used to span and attach the end portions 48 of the members 44 to the members 16. The profile of the members 16 above the molded portion 38 makes any special coping or notching of the end portions 48 unnecessary as the end portions 48 simply abut the flat surface 42 of the portion 36 of the members 16. The next step is to mount the cross braces 56 at right angles to the remaining two members 16 secured to the other two walls and also to the members 44 at regularly spaced intervals to complete the grid 12 beneath the ceiling.

Figure 5:
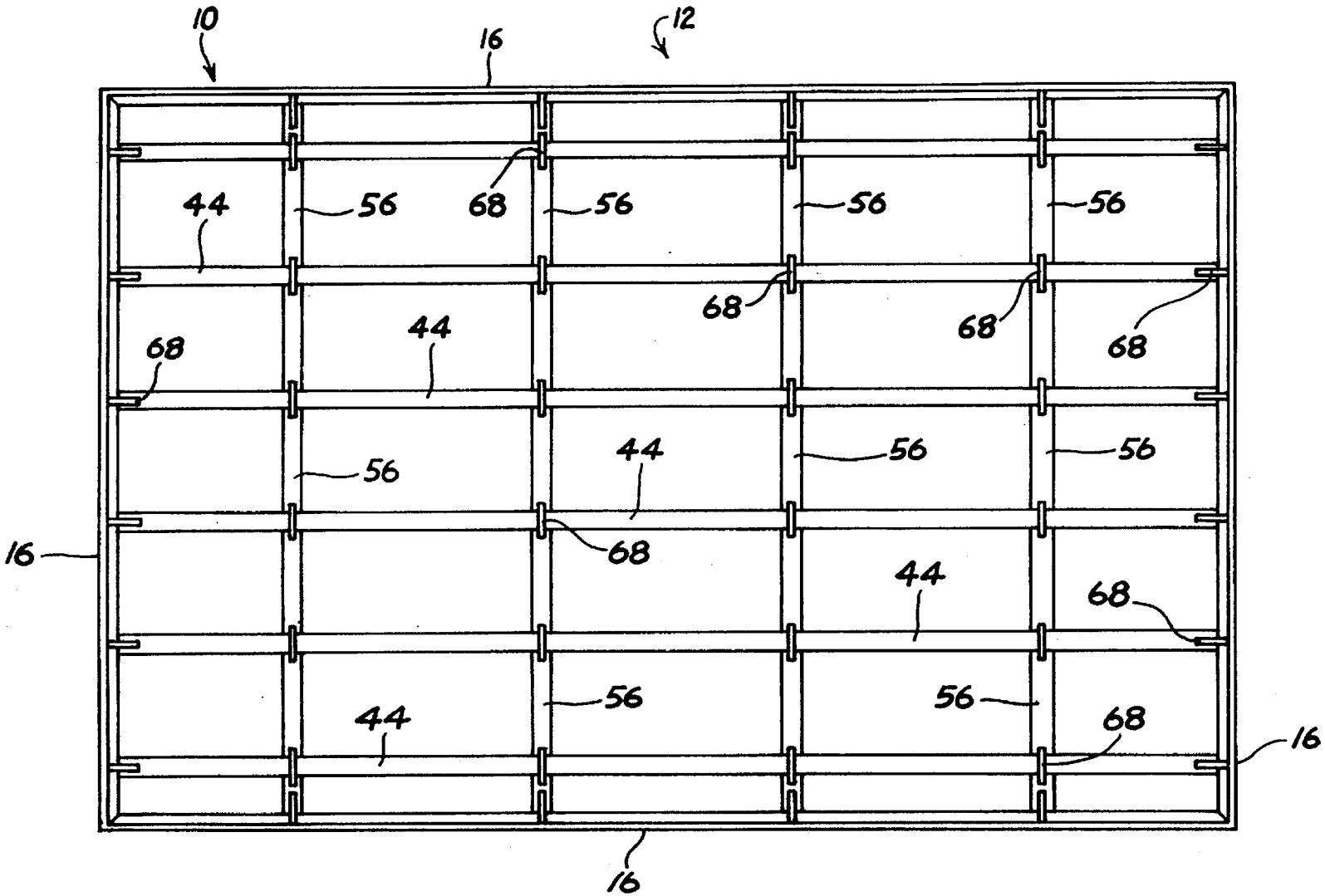
FIG. 5 is a top plan view of the suspended ceiling system first shown in FIG. 1 illustrating the grid formed beneath the overhead surface by the suspended ceiling system.

As illustrated in FIGS. 1, 3, and 5, the initial cross braces 56 are secured to one of the two members 16 which are not abutted by a main runner member 44. Clips 68 are used to attach the initial cross braces 56 to the member 16 in the same manner as the clips 68 were used to attach the members 44 to the members 16. The notched or coped end 66 of the cross braces 56 are interlocked or interfitted to the projecting arms 46 of a first adjacent row of members 44 and then clips 68 are attached to the runner portions 62 adjacent the coped ends 66 of the cross braces 56 while the notches 74 of the clips 68 accommodate the runner portions 52 of the members 44. Cross braces 56 are interlocked to an initial row of members 44 in this manner. The coped end 66 of the next cross brace 56 is then interlocked to the free projecting arm 46 of the first main runner member 44 of the first adjacent row and the arm 46 of the starter main runner member 44 of the next adjacent row. In order to keep the cross braces 56 in place, clips 68 are attached to the ends 66 of the cross braces 56 so that the sidewalls 72 encompass the runner portions 62. The notches 74 of the clips 68 accommodate and allow passage therethrough of the runner portions 52 of the runner members 44 and then the other half of the clips 68 slide down upon and contain the runner portions 62 of the next line of cross braces 56. In this way one clip 68 secures the connection between the ends 66 of two cross braces 56 and the projecting arms 46 of the runner members 44.

To further secure the clips 68 in place, wires 80 are then attached to or looped around the arched members 76 and then attached to respective fasteners inserted in the ceiling. One after another the cross braces 56 are interfitted to the rows of main runner members 44 so that the grid 12 is formed as shown in FIG. 5. The cross braces 56 are coped at both ends 66 and will generally come in lengths of two or four feet; however, if the distance between either the first or last rows of main runner members 44 and the adjacent members 16 is a non-standard distance, then the last series of cross braces 56 can be cut to span that distance. Since the members 16 do not require any special coped end for either the members 44 or the cross braces 56 to attach thereto, a straight cut can be made adjacent one of the coped ends 66 of the cross braces 56 and the straight cut end of the cross braces 56 can be abutted up against the flat surface 42 of the portion 36 of the member 16 while the opposite coped ends 66 of the cross braces 56 can be interfitted to the arms 46 of that first or last row of main runner members 44. Clips 68 can be then attached to the runner portions 62 of the cross braces 56 so that at least one clip 68 attaches the coped ends 66 of the cross braces 56 to the arms 46 of the members 44 while other clips 68 will span the straight cut ends of the cross braces 56 to partially rest upon the upwardly-facing surfaces 32 of the horizontal portions 30 of the members 16 in order to connect and support the cross braces 56 to the members 16. Clips 68 can be attached to any of the cross braces 56 and members 44 to provide additional support for the grid 12. In addition, the clips 68 can be slid along the runner portions 52 and 62 to better position the clips 68 before they are attached by some type of flexible wire means to the ceiling. Finally, the ceiling tiles 14, panels, lighting fixtures, and the like can be disposed within the grid 12 by placing the edges 34 on the receiving surfaces 50 of the arms 46 of the members 44, on the flat surfaces 60 of the cross brace arms 58, and on the surfaces 32 of the members 16. This completes one method or manner of installing the drop or suspended ceiling system 10 of the present invention.

Illustrated in FIGS. 6–11 is an alternate embodiment for the suspended ceiling system 10. The alternate embodiment is adapted for use with a suspended or drop ceiling framework 84 already in place and suspended from an overhead surface or ceiling. The following structural elements are used to support ceiling tiles 86 and panels in the typical framework 84 and the framework 84, the ceiling tiles 86, and the following structural elements are not part of the invention: a plurality of L-shaped metal wall angles 88 which are secured to the walls 90 and 92 of the room to form a perimeter thereon, a plurality of elongated, inverted, T-shaped metal main runners 94 which extend from the wall angle 88 which is secured to one wall and which spans the room to the wall angle 88 secured to the opposite wall and a plurality of elongated, inverted, T-shaped cross braces 96 which are disposed perpendicular to the main runners 94 and either rest upon or interconnect thereto in some manner to form a grid beneath the ceiling for receiving ceiling tiles 86, panels, lighting fixtures, and the like. When tiles 86 or panels are placed on the framework 84, the metal structural elements will not be covered up but will be viewable to anyone standing in the room and looking upward at the drop ceiling.

The alternate embodiment is designed to give a wood grain appearance to the in-place framework 84 by providing structural members which are removably attachable to and which completely cover the framework 84. In addition, the structural members of the alternate embodiment can be colored to meet the purchaser's specifications. The structural elements of the alternate embodiment are manufactured from a lightweight, pliable material such as pvc, styrene, or polyethylene, and the only tool needed for installation of the alternate embodiment is a utility knife.

Figure 6:
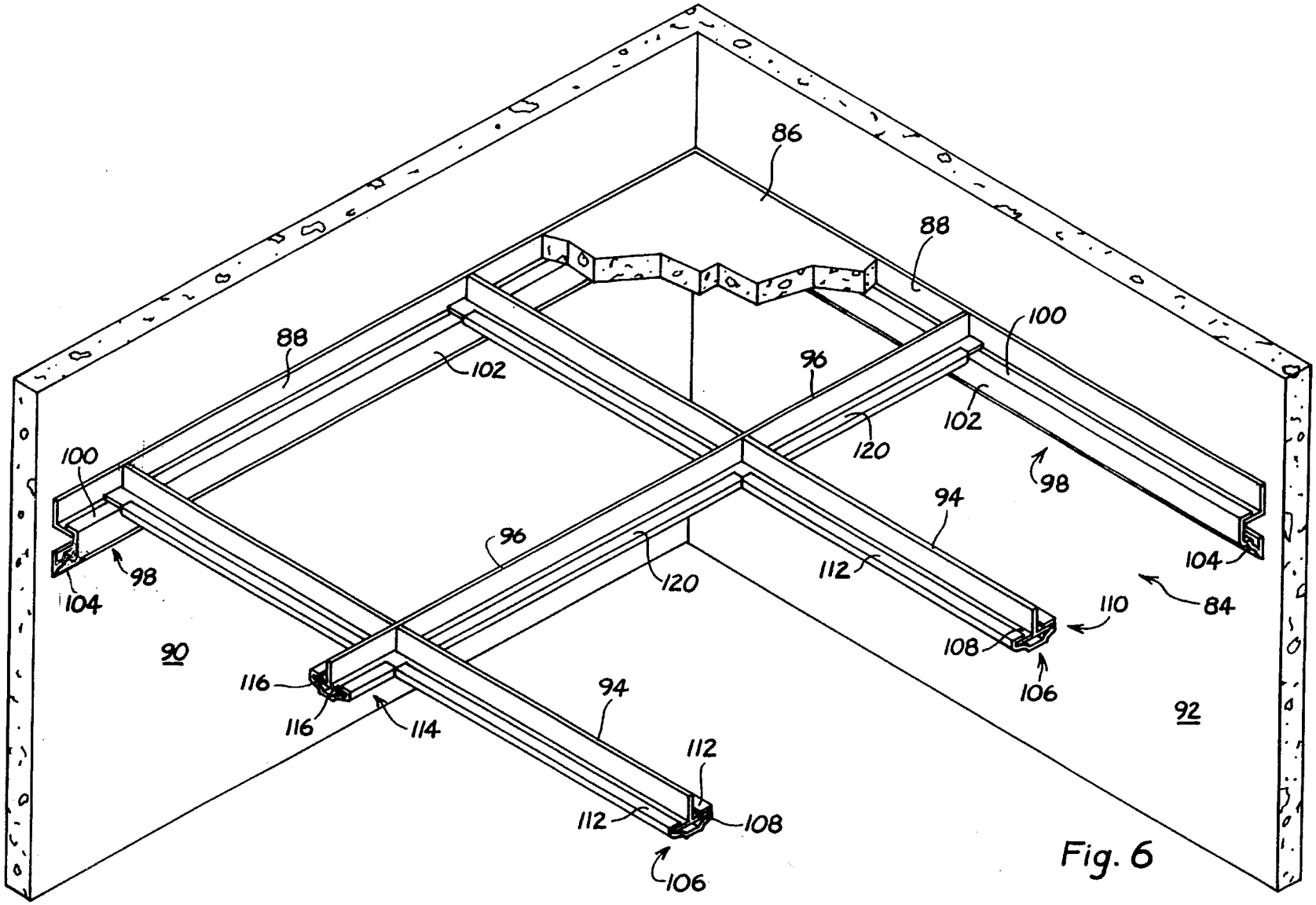
FIG. 6 is an isometric view of an alternate preferred embodiment of the system first shown in FIG. 1 illustrating an improvement for covering an in-place metal suspended ceiling framework.
Figure 7:
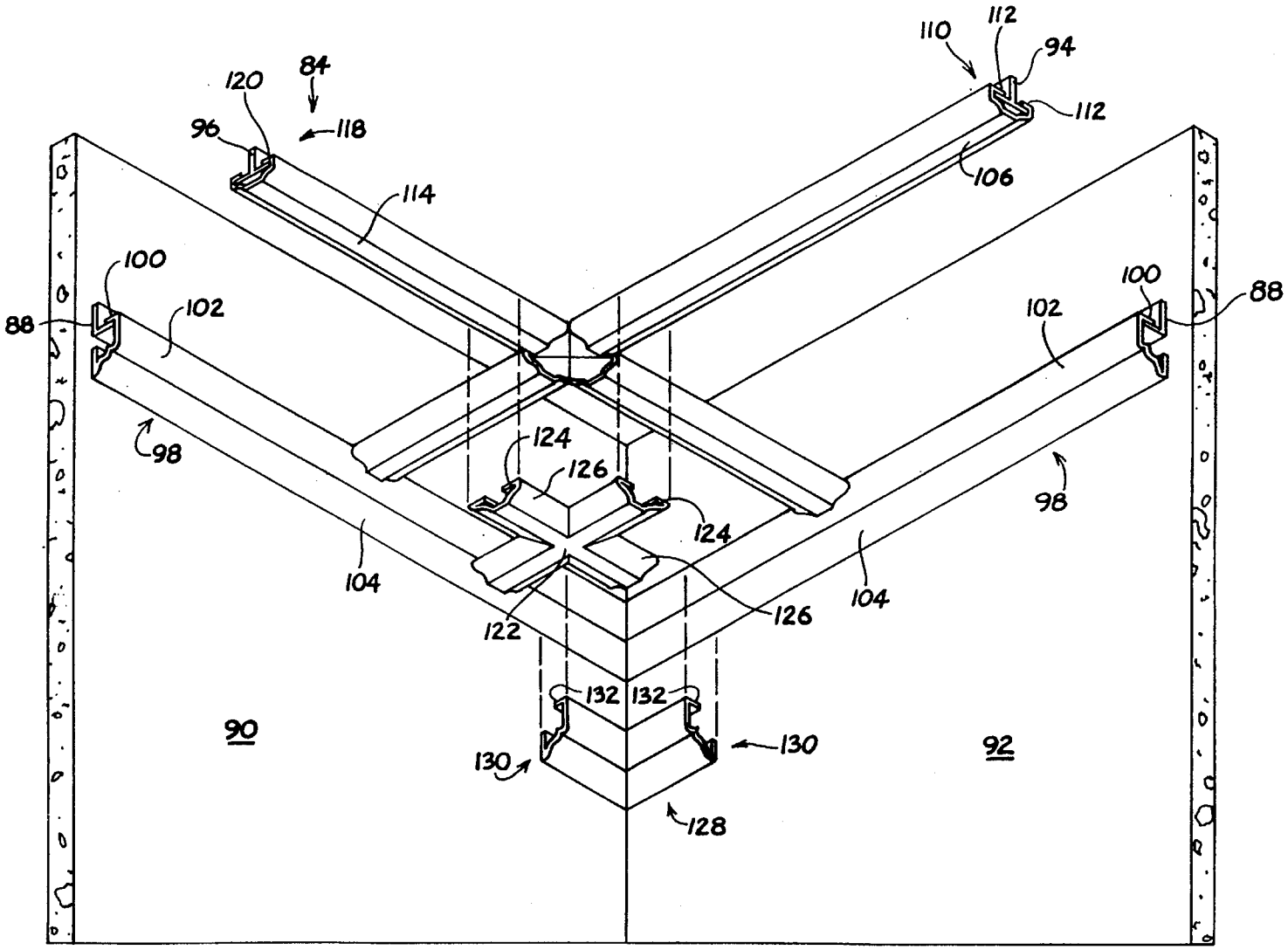
FIG. 7 is an isometric view of the improvement first shown in FIG. 6 illustrating the improvement as it would appear from a vantage point located beneath the suspended ceiling framework.

As shown in FIGS. 6–11, the alternate embodiment includes a plurality of elongated wall trim members 98 which are attached to the wall angles 88. Each member 98 includes a flat, horizontal surface portion 100 for resting upon the horizontal leg of the wall angles 88, a flat, vertical surface portion 102 which depends from and is integrally attached to the surface portion 100, and a molded portion 104 which is integrally attached to the surface portion 102 and which abuts the wall 90 or 92 to which the wall angles 88 are secured. The profile or contour of the molded portion 104 can vary widely; the molded portions 104 shown in FIGS. 6 and 7 are an example of one particular contour. The members 98 will come in standard eight foot long pieces and, for walls shorter than eight feet, the members 98 can easily be cut with a utility knife to fit on such walls.

Illustrated in FIGS. 6 and 7 are a plurality of elongated, generally V-shaped main runner cover members 106 for attachment to horizontally-projecting lips or flanges 108 of the main runners 94. More specifically, each cover member 106 includes opposed, straight, vertical ends 110 and a pair of elongated, opposed, integrally-turned flanges 112 which can be snapped or slid onto the flanges 108. As shown in FIGS. 6 and 7, the flanges 112 are flat, horizontally-projecting structural members integrally attached to the cover members 106 and coequal in length therewith.

As illustrated in FIGS. 6 and 7, the alternate embodiment also includes a plurality of elongated, generally V-shaped cross brace cover members 114 for snapping or sliding onto lips or flanges 116 of the braces 96 so that the braces 96 are completely covered by the cover members 114. Each cover member 114 includes straight, vertically-cut, opposed cover ends 118 and a pair of elongated, opposed, inwardly-turned cover flanges 120 which can be snapped and slid onto the flanges 116 and thus attaching the cover members 114 to the braces 96. The flanges 120 are flat and horizontally-projecting.

In addition, the alternate embodiment includes a plurality of joint cover members 122 as shown in FIG. 7. The cover members 122 have the shape of a plus sign and include four pairs of inwardly-turned, flat, horizontally-projecting flanges 124 with one pair of flanges 124 for each arm 126 of the cover members 122. Each cover member 122 is disposed to cover the intersection points of the grid where one pair of cross braces 96 intersects one main runner 94 at a right angle or the gap formed where one main runner 94 follows or precedes another main runner 94 in their extension across the room and also where two cross braces 96 meet at the main runners 94 and are connected perpendicularly thereto. The cover members 122 are adapted to be snapped and fiited over the flanges 108 and 116 to cover the slight gaps formed where these structural members are joined together in the framework 84 so that an individual viewing the drop ceiling will see a continuous wood grain grid.

Figure 8:
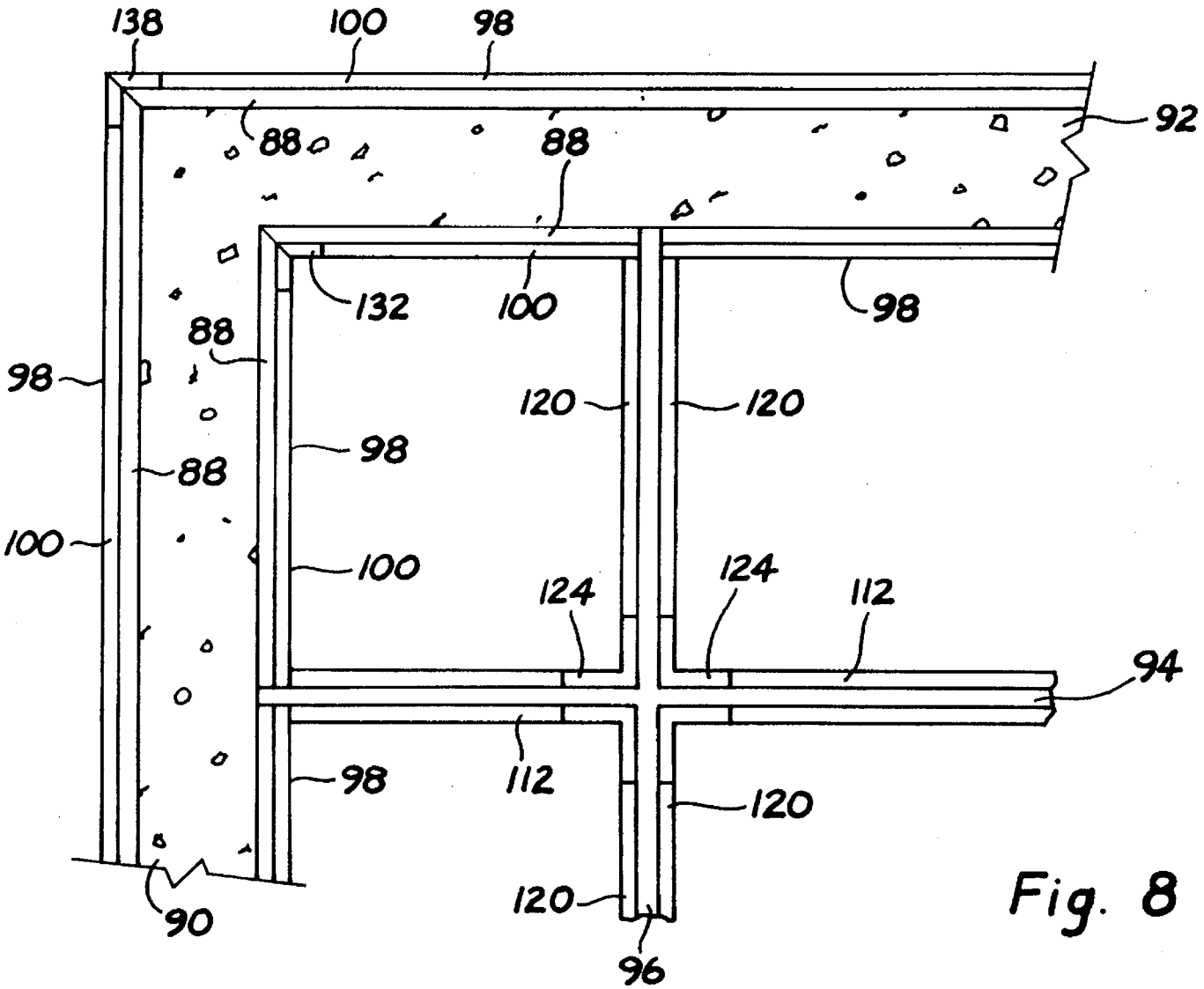
FIG. 8 is a top plan view of the improvement first shown in FIG. 6 illustrating the placement of one inside cover member and one outside cover member on respective metal wall angles.

In addition, the alternate embodiment includes structural members which are adapted to cover the end portions of two wall angles 88 which meet at the corner of a room as illustrated in FIG. 7. FIG. 7 illustrates two wall angles 88 which meet at an inside right angle corner of the room;

however, wall angles 88 could meet at a right angle—or any angle—on an inside or outside wall of a room or rooms. Therefore, the alternate embodiment of the present invention includes a plurality of right-angled inside cover members 128 which include a main body portion and opposed ends 130, and a flat, inwardly-turned, continuous, right-angled flange 132 capable of being snapped and slid onto the horizontal leg of the wall angles 88. In addition, as illustrated in FIG. 8, the alternate embodiment also includes a plurality of outside cover members 134 which include a main body portion and opposed end portions 136, and a flat, horizontally-projecting, continuous lip or flange 138 which is adapted to snap and slide onto the horizontal leg of the wall angles 88 for covering the ends of a pair of wall angles 88 that meet at a right angle on an outside corner of the room.

Figure 10:
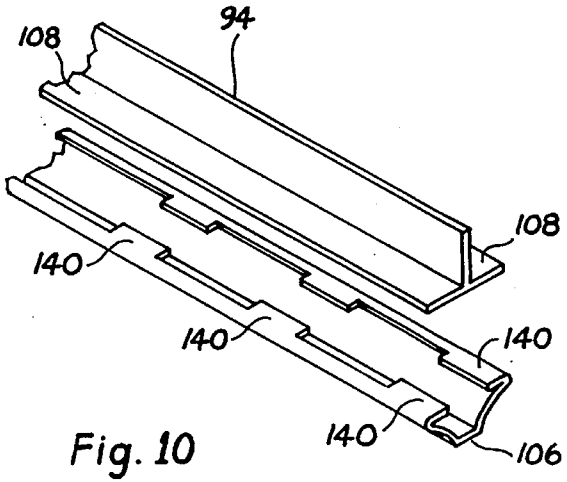
FIG 10 is an enlarged perspective view of a main runner cover member first shown in FIG. 6 illustrating a plurality of inwardly-facing tabs for resting upon the flanges of the inverted T-shaped metal main runners.

The shape and configuration of the above-described structural members of the alternate embodiment can be slightly modified to facilitate ease of installation and to provide a continuous simulated wood grain covering for the framework 84. For example, the surface portion 100 of trim members 98, and the flanges 112 and 120 of both cover members 106 and 114, can be replaced by structure similar to that shown in FIG. 10. FIG. 10 shows a cover member 106 having the same general profile as the cover members 106 shown in FIG. 6, except that the flanges 112 shown in FIG. 6 have been replaced by a plurality of opposed, inwardly-facing, spaced-apart main runner tabs 140 which can be snapped and slid onto the opposed flanges 108 of main runners 94 and which rest thereupon when the cover members 106 of FIG. 10 are attached to the main runners 94.

The cover members 114 illustrated in FIG. 6 may also have their flanges 120 replaced by a plurality of opposed, inwardly-facing, spaced-apart cross brace tabs similar to the tabs 140 shown in FIG. 10. The cross brace tabs would then snap and slide onto the opposed flanges 116 and would permit the cover members 114 to rest thereupon. In addition, the surface portion 100 may be replaced by a plurality of flat, horizontally spaced-apart tabs for snapping and sliding onto and resting upon the horizontal legs of the wall angles 88. The tabs should be at least as wide as the cover members 106. The tabs 140 would be spaced several inches or so apart and would replace the flanges 112 and 120 shown in FIGS. 6 and 7 if the cover members 106 and 114 are manufactured through an injection molding process as opposed to an extrusion process for the flanges 112 and 120. The same will hold if tabs are used to replace the surface portions 100.

Figure 11:
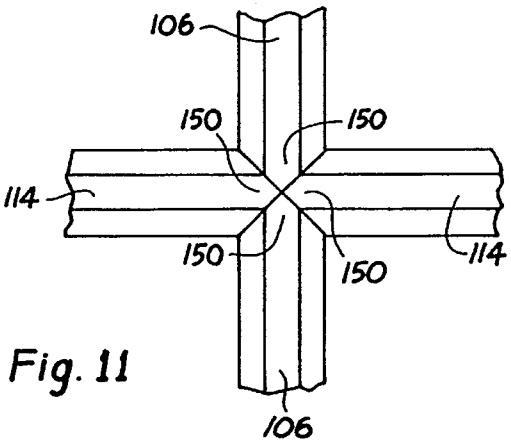
FIG. 11 is a fragmentary bottom plan view of the improvement first shown in FIG. 6 illustrating main runner cover members and cross brace cover members having tapered or V-shaped end portions that interlock at an intersection of the grid formed by the suspended ceiling framework.
Figure 9:
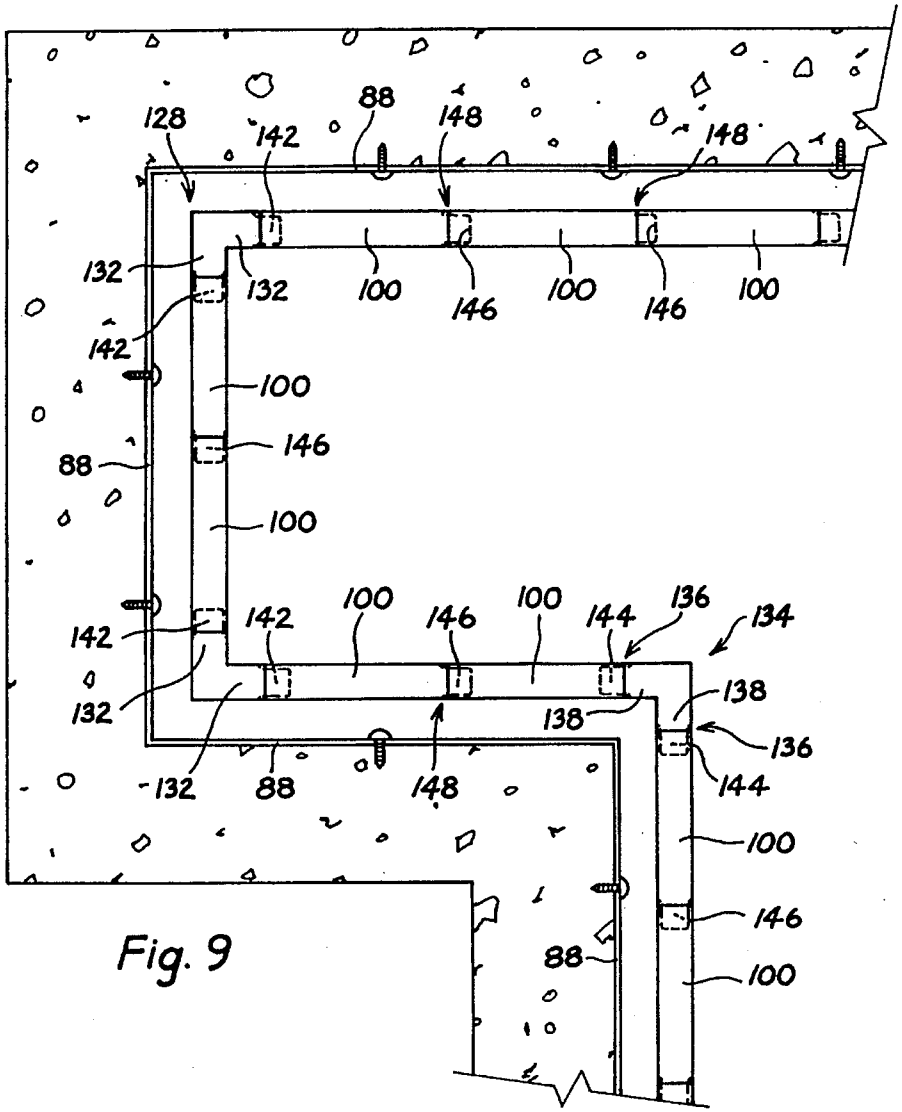
FIG. 9 is a top plan view of the improvement first shown in FIG. 8 illustrating the use of an inside cover member, an outside cover member, and wall trim members of various lengths, some of which have one reduced end portion.

FIGS. 9 and 11 illustrate several other variations to the structural members of the alternate embodiment which are designed to avoid any overlapping of one structural member with another during the process of covering the framework 84 and for providing a close fitting at intersection points on the grid.

With reference to FIG. 9, modifications to the members 98, 128, and 134 are shown. With regard to the cover members 128 and 134, the modification includes shrinking down and extending the size of the flanges 132 and 138 adjacent the opposed end portions so that they have a configuration of a rectangular tab 142 and have a width slightly less than that of the flanges 132 shown in FIG. 7. The width of the rectangular tabs 144 would also be slightly less than the width of the flanges 132 shown in FIG. 7. For both cover members 128 and 134, the tabs 142 and 144 would rest upon the horizontal legs of adjacent wall angles 88 as shown in FIG. 9.

In addition, as illustrated in FIG. 9, at least one end portion of each member 98 can include a rectangular tab 146. The tab 146 would project outward from and in the same plane as the surface portions 100 and would have a width slightly less than that of the surface portions 100. Thus, as illustrated in FIG. 9, the straight-cut end portion of one member 98 would overlap the tab 142 or 144 while the tab 146 of that member 98 would be disposed underneath the straight-cut end portion of the next abutting member 98. The placement of the straight-cut end portion of one member 98 superjacent to the tab 146 of an adjacent and abutting member 98, or the tabs 142 and 144 of cover members 128 and 134, permits a tight and close fitting for members 98, 128, and 134 when they are all disposed in linear succession on one or more wall angles 88. Also, this variation closes gaps between members 98, 128, and 134, and avoids raising the edges of the ceiling tiles 86 that rest upon the surface portions 100 and the flanges 132 and 138 of cover members 128 and 134.

Furthermore, as illustrated in FIG. 9, because the members 98 are manufactured from a lightweight, pliable plastic, they can be cut with a utility knife to fit any odd space, such as the space shown in FIG. 9, whereby a gap between one cover member 134 and one member 98 remains to be filled. In order to cover this area on the wall angle 88, the installer can simply make a straight cut with a utility knife at both end portions 148 so that the member 98 is cut to the appropriate length, and then the installer can snap and slide the surface portion 100 over the horizontal leg of the wall angle 88 covering the tab 144 of cover member 134 and the tab 146 for the adjacent member 98. Therefore, members 98 and cover members 128 and 134, illustrated in FIGS. 6 and 7, as well as the variation illustrated in FIG. 9, will cover in one continuous uninterrupted line, without gaps or upraised sections, walls of any width as well as structures wherein adjacent or adjoining rooms form inside and outside corners of varying angles.

Finally, the end portions of both cover members 106 and 114 shown in FIGS. 6 and 7 can be altered to a tapered or V-shaped configuration as illustrated in FIG. 11. V-shaped end portions 150 would obviate the need for cover members 122 shown in FIG. 7 as the intersection points on the framework grid would be covered by the joining or interlocking of the end portions 150. In order to start cover members 106 and 114 from the surface portions 102 of the members 98, the installer would simply make a straight cut on one V-shaped end portion 150, thus eliminating it and providing a straight edge for abutment against the surface portion 102 of the member 98.

The foregoing is a description of a preferred embodiment and several alternate embodiments of the present invention. The present invention, in its preferred embodiment and also in its alternate embodiments, is not to be taken as limited to any of the specific features as described, but comprehends all such variations thereof as come within the scope of the appended claims.

I claim:

1. In a suspended ceiling framework including a plurality of L-shaped metal wall angles for securement to the walls that form the perimeter of a room, a plurality of elongated, inverted, T-shaped metal main runners supported by and extending from the metal wall angles, and a plurality of elongated, inverted T-shaped metal cross braces which are secured to the metal main runners for forming a grid beneath a ceiling of the room, the improvement comprising:

a plurality of elongated wall trim cover members for resting upon the L-shaped metal wall angles and which include a molded portion for abutting the walls;

a plurality of, elongated, generally V-shaped main runner cover members which include a pair of elongated, opposed, inwardly-turned flanges for snapping and sliding onto and covering the inverted T-shaped main runners;

a plurality of elongated, generally V-shaped cross brace cover members which include a pair of elongated, opposed, inwardly-turned cover flanges for snapping sliding onto covering the inverted T-shaped cross braces; and a plurality of joint cover members with each joint cover member having four pairs of inwardly-turned cross-T flanges for snapping and sliding onto and covering the end portions of the inverted T-shaped main runners, the inverted T-shaped cross braces, main runner cover members, and cross brace cover members at intersection points in the grid.

2. The suspended ceiling framework of claim 1 further comprising a plurality of inside cover members having a main body portion and opposed end portions and which snap and slide onto and cover the ends of the two adjacent L-shaped wall angles that meet at a right angle at an inside corner perimeter of the room.

3. The suspended ceiling framework of claim 1 further comprising a plurality of outside cover members having a main body portion and opposed end portions and which snap and slide onto and cover the ends of two adjacent L-shaped wall angles that meet at a right angle at an outside corner perimeter of the room.

4. The suspended ceiling framework of claim 3 wherein the opposed end portions of the outside cover members are in the shape of a rectangular tab.

5. The suspended ceiling framework of claim 4 wherein the opposed end portions of the inside cover members are in the shape of a rectangular tab.

6. The suspended ceiling framework of claim 1 wherein each wall trim member includes a pair of opposed end wall trim portions.

7. The suspended ceiling framework of claim 6 wherein each wall trim member includes a flat, horizontal surface portion for resting upon the L-shaped metal wall angles and which is coequal in length with the wall trim member.

8. The suspended ceiling framework of claim 7 wherein at least one end wall trim portion includes a flat, rectangular-shaped tab having a width less than that of the flat, horizontal surface portion and which is located in the same plane as the horizontal surface portion.

9. The suspended ceiling framework of claim 1 wherein each wall trim member includes a plurality of flat, horizontal, spaced-apart tabs for snapping and sliding onto the L-shaped wall angles so that the tabs rest thereupon.

10. The suspended ceiling framework of claim 1 wherein each main runner cover member includes a plurality of opposed, inwardly-facing, spaced-apart main runner tabs which snap and slide onto the flanges of the inverted T-shaped main runners and rest thereupon.

11. The suspended ceiling framework of claim 1 wherein each cross brace cover member includes a plurality of opposed, inwardly-facing, spaced-apart cross brace tabs which snap and slide onto the flanges of the inverted, T-shaped cross braces and rest thereon.

12. The suspended ceiling framework of claim 1 wherein each main runner cover member includes a pair of oppositely-disposed V-shaped end portions.

13. The suspended ceiling framework of claim 1 wherein each cross brace cover member includes a pair of oppositely-disposed V-shaped end portions.

* * * * *

UNITED STATES PATENT AND TRADEMARK OFFICE

CERTIFICATE OF CORRECTION

PATENT NO. : 5,619,833
DATED : April 15, 1997
INVENTOR(S) : Eric S. Neff

It is certified that error appears in the above-indentified patent and that said Letters Patent is hereby corrected as shown below:

In Claim 1, column 13, line 6, of the Patent, after "snapping", please insert --and--; line 7, after "sliding onto", insert --and--.

Signed and Sealed this

Ninth Day of September, 1997

*Attest:*

*Attesting Officer*

BRUCE LEHMAN

*Commissioner of Patents and Trademarks*